US010648262B2

(12) United States Patent
Tran

(10) Patent No.: US 10,648,262 B2
(45) Date of Patent: May 12, 2020

(54) RUNNING TOOL FOR USE WITH BEARING ASSEMBLY

(71) Applicant: Schlumberger Technology Corporation, Sugar Land, TX (US)

(72) Inventor: Lap Tran, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 26 days.

(21) Appl. No.: 15/771,952

(22) PCT Filed: Nov. 7, 2016

(86) PCT No.: PCT/US2016/060772

§ 371 (c)(1),
(2) Date: Apr. 27, 2018

(87) PCT Pub. No.: WO2017/079716

PCT Pub. Date: May 11, 2017

(65) Prior Publication Data

US 2018/0340386 A1 Nov. 29, 2018

Related U.S. Application Data

(60) Provisional application No. 62/251,483, filed on Nov. 5, 2015.

(51) Int. Cl.

| | |
|---|---|
| ***E21B 23/00*** | (2006.01) |
| ***E21B 31/18*** | (2006.01) |
| *E21B 33/08* | (2006.01) |

(52) U.S. Cl.
CPC ..... *E21B 23/00* (2013.01); *E21B 31/18* (2013.01); *E21B 33/085* (2013.01)

(58) Field of Classification Search
CPC ..... E21B 31/20; E21B 31/18; E21B 23/00
See application file for complete search history.

(56) References Cited

U.S. PATENT DOCUMENTS

| | | | | |
|---|---|---|---|---|
| 3,856,081 | A * | 12/1974 | Canalizo | E21B 23/02 166/123 |
| 2003/0183396 | A1 | 10/2003 | Adams et al. | |
| 2012/0085545 | A1 | 4/2012 | Tarique et al. | |
| 2012/0168178 | A1 | 7/2012 | Eriksen et al. | |
| 2014/0216721 | A1 | 8/2014 | DeWesee, Jr. et al. | |
| 2015/0060049 | A1 | 3/2015 | Saurer et al. | |

OTHER PUBLICATIONS

International Preliminary Report on Patentability for the equivalent International application PCT/US2016/060772 dated May 17, 2018.
International Search Report and Written Opinion for the equivalent International application PCT/US2016/060772 dated Feb. 15, 2017.

* cited by examiner

*Primary Examiner* — Kristyn A Hall
(74) *Attorney, Agent, or Firm* — Jeffrey D. Frantz

(57) ABSTRACT

A tool has an elongated body having an outer surface, a first recess formed at a first axial position along the outer surface, and a second recess formed at a second axial position along the outer surface. The tool also includes a gripping element that has a plurality of collets at a gripping portion of the gripping element and a retention end. A retention mechanism axially retains the retention end of the gripping element within an axial length along the body to allow the plurality of collets to overlap with the first axial position and the second axial position of the body.

8 Claims, 14 Drawing Sheets

RUNNING TOOL FOR USE WITH BEARING ASSEMBLY

CROSS-REFERENCE TO RELATED APPLICATIONS

This application claims priority to U.S. Provisional Patent Application having Ser. No. 62/251,483, which was filed on Nov. 5, 2015, incorporated herein by reference in its entirety.

BACKGROUND

When drilling for oil and gas, a wellbore or borehole of an oil or gas well is typically drilled from surface to a first depth and lined with a steel casing. The casing is located in the wellbore extending from a wellhead provided at surface or seabed level, and is then cemented in place. Following testing and other downhole procedures, the borehole may be extended to a second depth and a further section of casing is installed and cemented in place. This process may be repeated until the borehole has been extended to a location where it intersects a producing formation.

Drilling, production and completion of offshore wells from a floating platform, e.g., a vessel, tension leg platform, etc. may be conducted through a riser assembly which extends from the platform to the wellhead at the seabed level. The riser assembly includes a series of pipe sections connected end to end. Marine drilling risers provide a conduit through which materials may flow between the platform and the wellbore.

Marine managed pressure drilling may include wellbore pressure control devices, e.g., devices known as rotating control devices, rotating diverters, rotating blowout preventers (hereinafter, rotating control device or "RCD"), disposed at a selected position along the length of the riser assembly. Such pressure control devices are configured to enable a string of pipe and/or wellbore drilling or intervention tools to sealingly pass there through axially, and further to enable rotation of the pipe while sealing the wellbore hydraulically. When used, for example in wellbore drilling operations, a drill pipe string is passed through a bearing assembly in the RCD. The bearing assembly enables a sealing element therein and the pipe to rotate relative to a housing that may be affixed to the top of a casing or other pipe disposed at least partially into the wellbore. The housing is configured to enable hydraulic communication to the interior of the wellbore below the bearing assembly.

When bearings, seals, or other elements in the bearing assembly fail, expensive and difficult procedures to remove the pipe from the wellbore may be conducted while maintaining the wellbore hydraulic seal through the RCD.

DETAILED DESCRIPTION

Embodiments of the present disclosure relate generally to running tools, which may be used to install or retrieve devices from piping used in downhole operations. For example, running tools disclosed herein may be used to install or retrieve a bearing package for a rotating control device ("RCD"). Embodiments of the present disclosure also relate generally to methods of inserting and retrieving bearing assemblies in an RCD using running tools.

Figure 1:
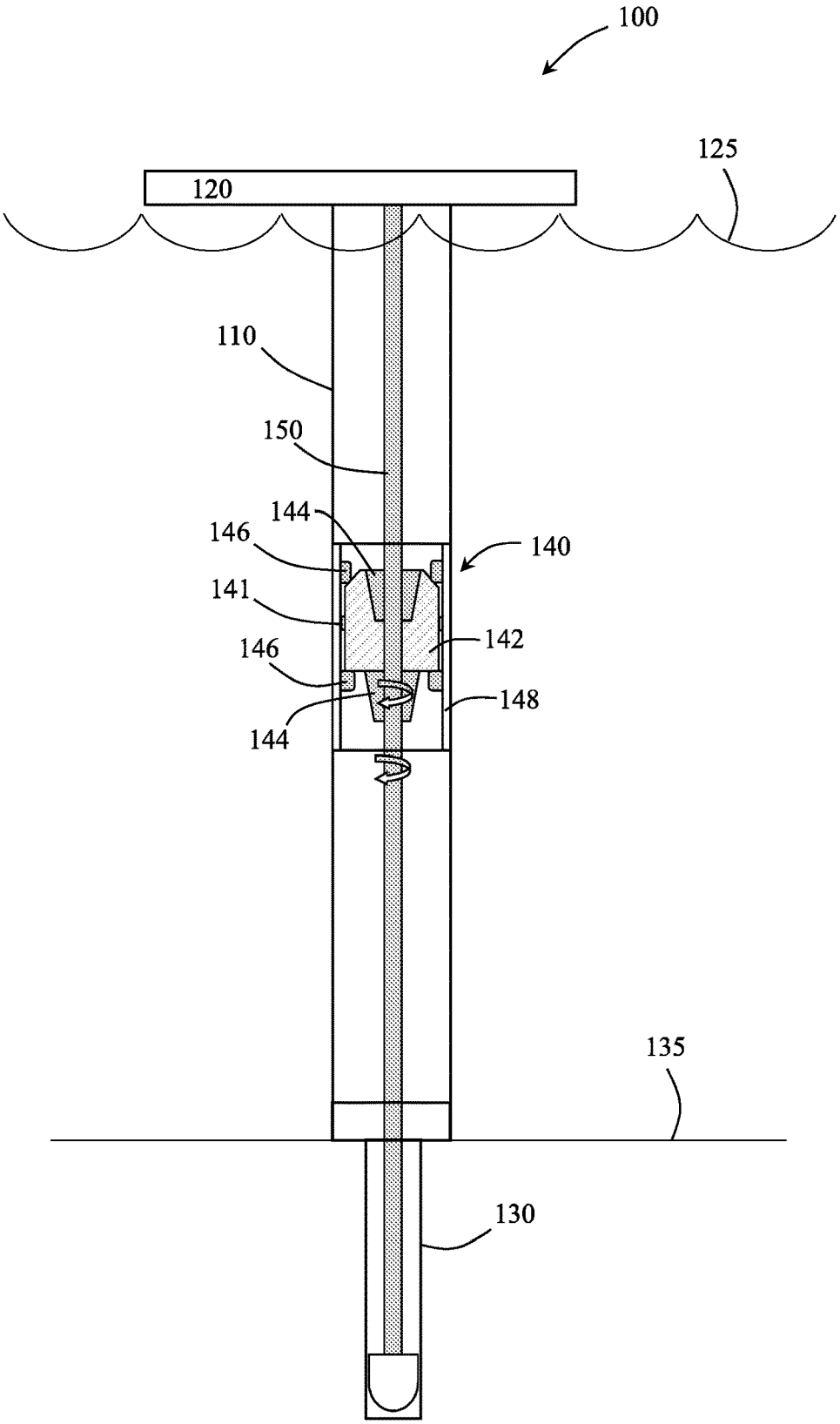
FIG. 1 shows a drilling system according to embodiments of the present disclosure.

FIG. 1 shows a diagram of a drilling system 100 that includes a riser assembly 110 extending from a platform 120 at sea level 125 to a wellbore 130 drilled at the sea floor 135. The riser assembly 110 includes an RCD assembly 140 having a bearing assembly 142, at least one sealing component 144, latching components 146, and an RCD housing 148. The sealing components 144 may be referred to as sealing elements or packers. As shown, in some embodiments, there may be an upper sealing element 144 and a lower sealing element 144. Also shown is a drill string 150 extending through the riser assembly 110 and RCD sealing components 144. The sealing elements 144 grip around the drill string 150 such that the sealing elements 144 rotate with the drill string 150. A bearing outer seal 141 may be disposed between the bearing assembly 142 and the RCD housing 148. The latching components 146 may include landing pistons and latching pistons to hold the bearing assembly 142 in place within the RCD assembly 140. However, other types of latching components may be used to secure the bearing assembly 142.

According to embodiments of the present disclosure, a running tool may be used to install a bearing assembly within an RCD and/or retrieve the bearing assembly from the RCD. Bearing assemblies may be retrieved and installed in an RCD that is assembled along a riser assembly. For example, according to embodiments of the present disclosure, a bearing assembly may be retrieved from an RCD assembled to a riser assembly in an offshore drilling operation to repair or replace the bearing assembly rather than disassembling and removing the entire RCD assembly.

Running tools may have an outer profile narrower than a central conduit formed through or a central bore of risers or casings, such that the running tools may be inserted through the risers or casings to access one or more elements within the risers or casings, such as a bearing assembly. Running tools may range in length, for example, from 5 ft (1.5 m) to 30 ft (9.1 m). However, some running tools may be less than 5 ft (1.5 m) in length, and some running tools may be greater than 30 ft (9.1 m). Running tools may be connected to a drill string, e.g., by a threaded connection, to be sent down risers or casings. For example, a running tool may be connected to a drill string and sent down to an RCD assembly, anywhere from a rig floor to the seabed.

Running tools may further include a gripping element disposed around an elongate body, where the gripping element may have a radially compressible gripping portion, and where the body may have a corresponding shape to allow the gripping portion to radially compress when engaging or disengaging from another tool (e.g., a bearing assembly). When installing a bearing assembly to an RCD assembly, a running tool may be used to insert the bearing assembly into the RCD assembly, and once the bearing assembly is secured to the RCD assembly, the running tool may be retrieved, leaving the bearing assembly installed within the RCD assembly. When retrieving a bearing assembly, a running tool may be engaged with the bearing assembly, the bearing assembly may be detached from the RCD assembly, and the running tool may be retrieved while gripping the bearing assembly to retrieve the bearing assembly along with the running tool.

Figure 2:
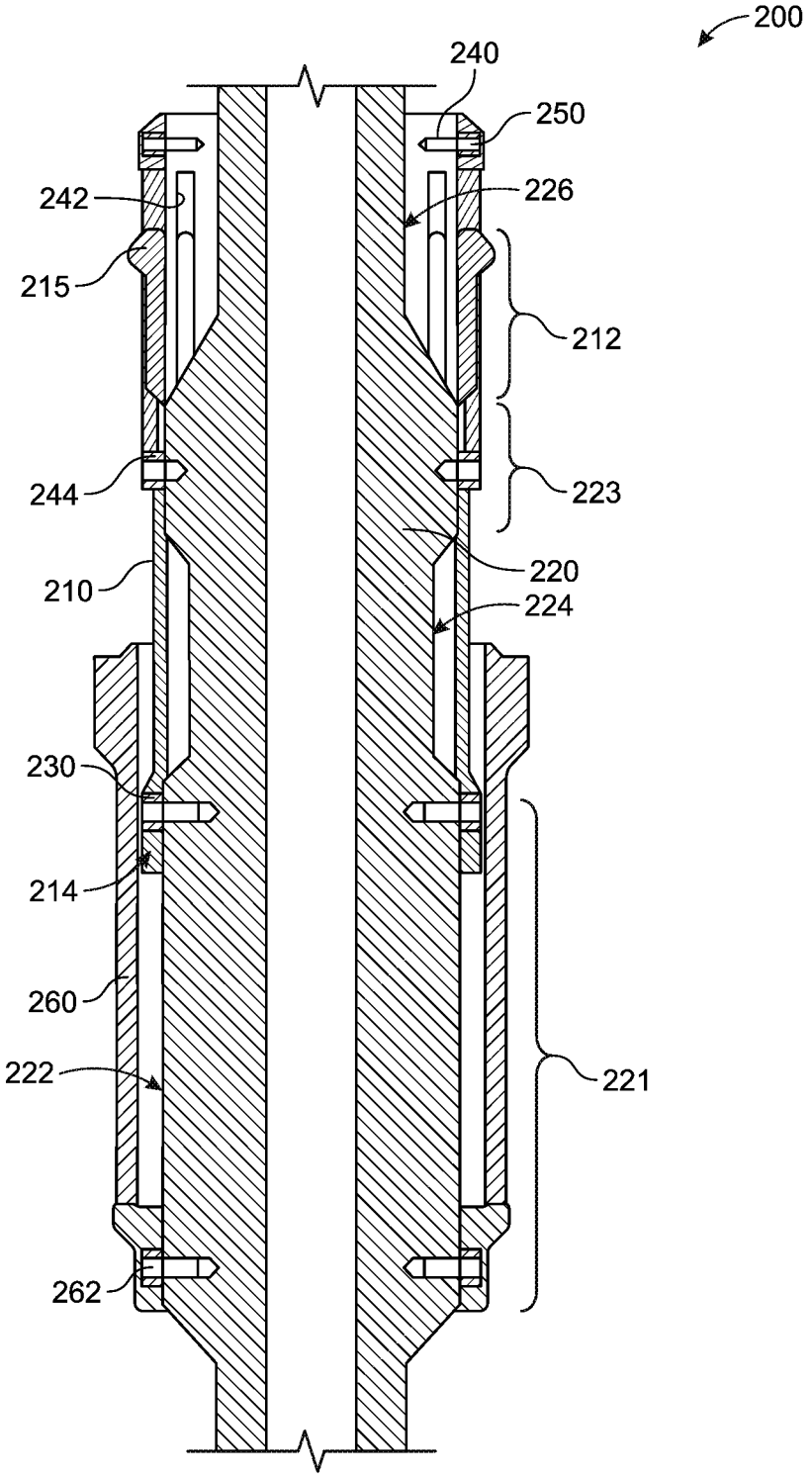
FIG. 2 shows a cross sectional view of a running tool according to embodiments of the present disclosure.
Figure 3:
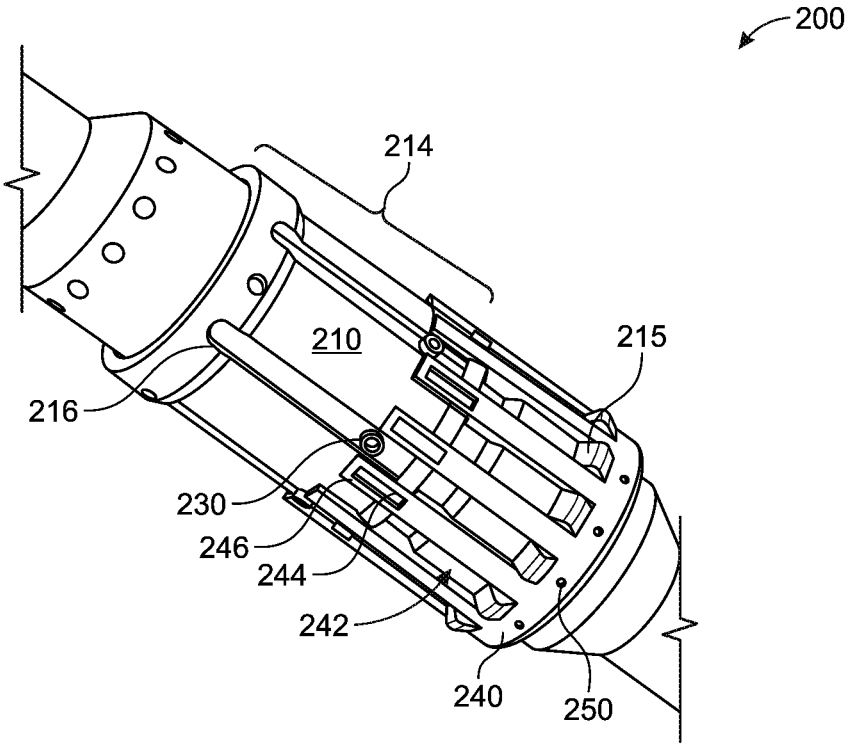
FIG. 3 shows a partially deconstructed perspective view of the running tool of FIG. 2.
Figure 4:
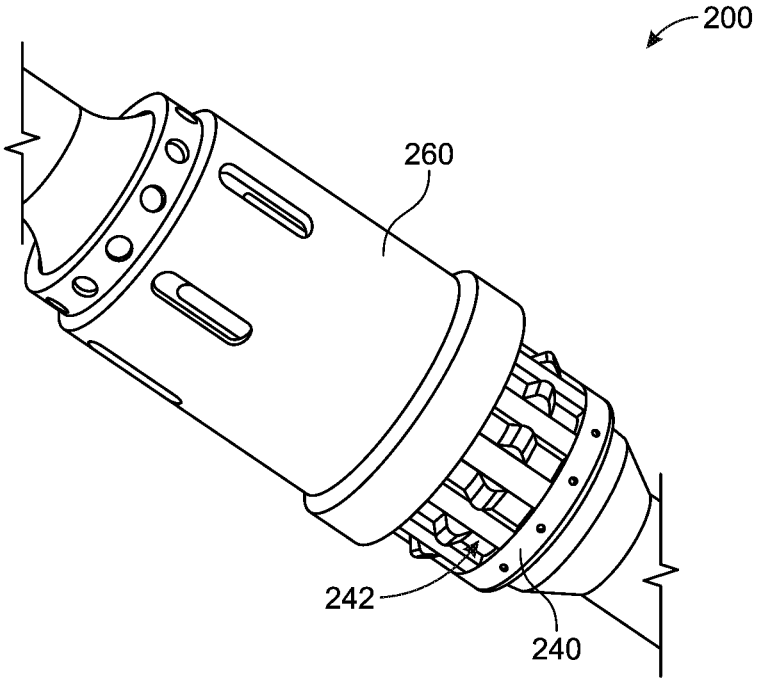
FIG. 4 shows a perspective view of the running tool of FIGS. 2 and 3.

FIGS. 2-4 collectively show a running tool 200 according to embodiments of the present disclosure that includes a gripping element 210 having a radially compressible gripping portion 212 disposed around an elongate body 220, where the gripping portion 212 may be used to engage with a distal end of a bearing assembly, either to install or retrieve the bearing assembly. FIG. 2 shows a cross sectional view of the running tool 200 along its axial length; FIG. 3 shows a partially disassembled perspective view of the running tool 200; and FIG. 4 shows a perspective view of the running tool 200.

The body 220 has an outer surface 222, a first recess 224 formed at a first axial position along the outer surface 222, and a second recess 226 formed at a second axial position along the outer surface 222. In some embodiments, the body 220 may have a generally cylindrical shape having a first diameter with at least one recess formed at a first axial position and at least one recess formed at a second axial position, where the first axial position and second axial position have diameters smaller than the first diameter. In some embodiments, such as shown in FIG. 2, the body 220 may have a generally cylindrical shape having a first diameter and at least two wider portions 221, 223 having diameters larger than the first diameter, where portions of the body having the first diameter may form the first recess 224 (between wider portions 221, 223) and the second recess 226 (adjacent to wider portion 223 and opposite first recess 224).

Recesses formed in a body may include an annular recess extending entirely around the circumference of the body, or may include multiple recesses formed around the circumference of the body in a single axial position along the length of the body. For example, in some embodiments, a plurality of recesses may be formed around a circumference of the body at a first axial position, where the size and orientation of the recesses around the circumference may correspond to the size and orientation of a gripping portion of a gripping element. In embodiments with a gripping portion having a plurality of spaced apart collets (i.e., a collet sleeve having a plurality of collet fingers) disposed around a running tool body, a plurality of recesses having a corresponding shape (e.g., linear grooves) to the shape of the collets may be formed around the circumference of the body in a correspondingly spaced apart position with the collets, such that when the collets are in the same or overlapping axial position as the recesses, the collets may radially retract within the recesses.

In some embodiments, the running tool 200 may further include an outer housing 260 attached to the body 220, for example, using screws 262 or other retention mechanisms. The outer housing 260 may define an annular space between the outer housing 260 and the body 220, where the gripping element 210 may be partially disposed in the annular space.

As shown in FIGS. 2 and 3, gripping element 210 extends concentrically around the body 220 and includes a plurality of collets 215 at a gripping portion 212 of the gripping element 210. At least one retention mechanism 230 slidably retains a retention end 214 of the gripping element 210 to the body 220 such that the gripping element 210 may slide within an axial length along the body 220. In other words, the gripping element may be formed as a single piece having a retention end 214 and a gripping portion 212 at an axial end opposite from the retention end 214, such that the gripping portion 212 slides together with the retention end 214 when the retention end 214 moves along the axial length of the body 220. The axial length along which the gripping element 210 may slide may include an axial position along the body where the collets 215 overlap with the first axial position to be concentric with and rotationally aligned with the first recess 224 (such that the collets are capable of being received within the first recess) and an axial position along the body where the collets 215 overlap with the second axial position to be concentric with and rotationally aligned with the second recess 226 (such that the collets are capable of being received within the second recess).

As shown in FIG. 3, the retention end 214 may have a plurality of slots 216 formed axially along a length of the gripping element 210. The retention mechanisms 230 may be cap screws that extend through the slots 216 and attach to the body 220. The retention end 214 of the gripping element 210 (and thus the entire gripping element 210) may slide a distance along the body 220 equal to a length of the slots 216 in which the cap screws are capable of moving within.

A shear sleeve 240 having a plurality of openings 242 is disposed around the gripping portion 212 of the gripping element 210, such that each collet 215 is exposed through each of the openings 242. The shear sleeve 240 may be slidably coupled to the gripping element 210, where the shear sleeve may axially move relative to the gripping element 210 and the gripping element 210 may axially move relative to the body 220. For example, as shown in FIG. 3, a retention mechanism such as cap screws 244 may be inserted through retention slots 246 formed in an axial end of the shear sleeve 240, where the shear sleeve 240 is capable of moving axially with respect to the gripping element 210 a distance equal to a length of retention slots 246 in which the cap screws 244 are capable of moving within.

A breakable retention mechanism 250 may further attach the shear sleeve 240 to the running tool body 220. As shown, the breakable retention mechanism 250 may be shear screws inserted through an opposite axial end from the retention slots 246 and into the body 220. When a shear force (e.g., exerted during engaging the running tool with a bearing assembly) on the shear screws is large enough to overcome the shear strength of the shear screws, the shear screws may fail, thereby allowing the shear sleeve 240 to axially move with respect to the gripping element 210. In embodiments where the running tool 200 is used to install a bearing assembly in an RCD, the shear force to break the attachment between the shear sleeve and the body may be less than a latching force from at least one latch securing the bearing assembly within the RCD.

Figure 5:
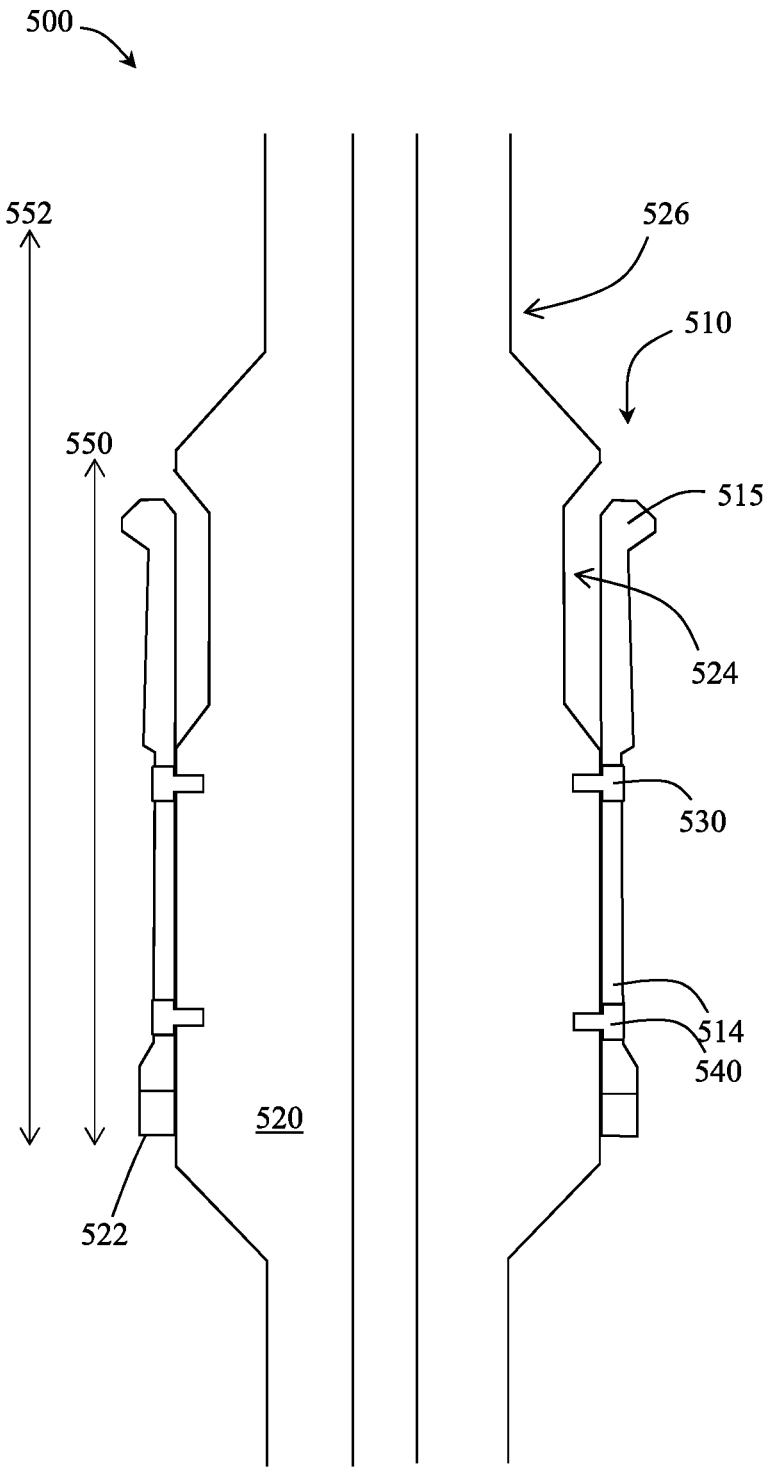
FIG. 5 shows a cross sectional view of a running tool according to embodiments of the present disclosure.

In some embodiments, a gripping element may be temporarily restrained within an axial range without the use of a shear sleeve. For example, in some embodiments, a breakable retention mechanism may be disposed along a retention end of the gripping element. FIG. 5 shows an example of a running tool 500 having a gripping element 510 disposed around an elongate body 520, where the gripping element 510 is both detachably restrained in a first axial range 550 and fixedly restrained in a second axial range 552. The gripping element 510 has a plurality of slots formed at a retention end, through which a breakable retention mechanism 540 may be inserted and attached into the body 520 at a first axial position along the body, and through which a permanent retention mechanism 530 may be inserted and attached into the body 520 at a second axial position. The slots may axially slide around the breakable retention mechanisms 540 and the permanent retention mechanisms 530, where the breakable retention mechanisms 540 restricts axial movement of the slots from moving past the first axial position, and where the permanent retention mechanisms 530 restricts axial movement of the slots from moving past the second axial position. When the breakable retention mechanisms 540 are intact, the gripping element 510 may slide a first axial range 550 equal to the length of the gripping element plus the range of axial movement allowed by the permanent and breakable retention mechanisms 530, 540 (i.e., the range of axial movement of the slots around the permanent and breakable retention mechanisms 530, 540). When the breakable retention mechanisms 540 fail (e.g., from a shear force large enough to overcome the shear strength of the breakable retention mechanisms), the gripping element 510 may slide a second axial range 552 equal to the length of the gripping element plus the range of axial movement allowed by the permanent retention mechanisms 530 (i.e., the range of axial movement of the slots around the permanent retention mechanisms 530). The width of the slots of the gripping element is sized to correspond to the width of the retention mechanisms 530, 540 to secure the griping element 510 to the body 520 and restrict rotational movement of the gripping element.

The gripping element 510 includes a plurality of collets 515 at a gripping portion of the gripping element 510, opposite the retention end 514 of the gripping element 510. When the gripping element 510 is axially restrained in the first axial range 550, and when the collets 515 share an axial position with the recesses 524 formed around a circumference of the body 520, the collets 515 are capable of radially compressing within the recesses 524. When the gripping element 510 is axially restrained in the second axial range 552, the collets 515 are capable of radially compressing within the recesses 524 when the collets 515 share an axial position with the recesses 524, and the collets 515 are capable of radially compressing within a second recess 526 when the collets 515 share an axial position with the second recess 526. In embodiments in which the recesses 524, 526 include multiple recesses formed around the circumference of the body in a single axial position along the length of the body, the collets 515 are rotationally aligned with the multiple recesses when the gripping element 510 and retention mechanisms 530, 540 are assembled to the body 520.

Figure 6:
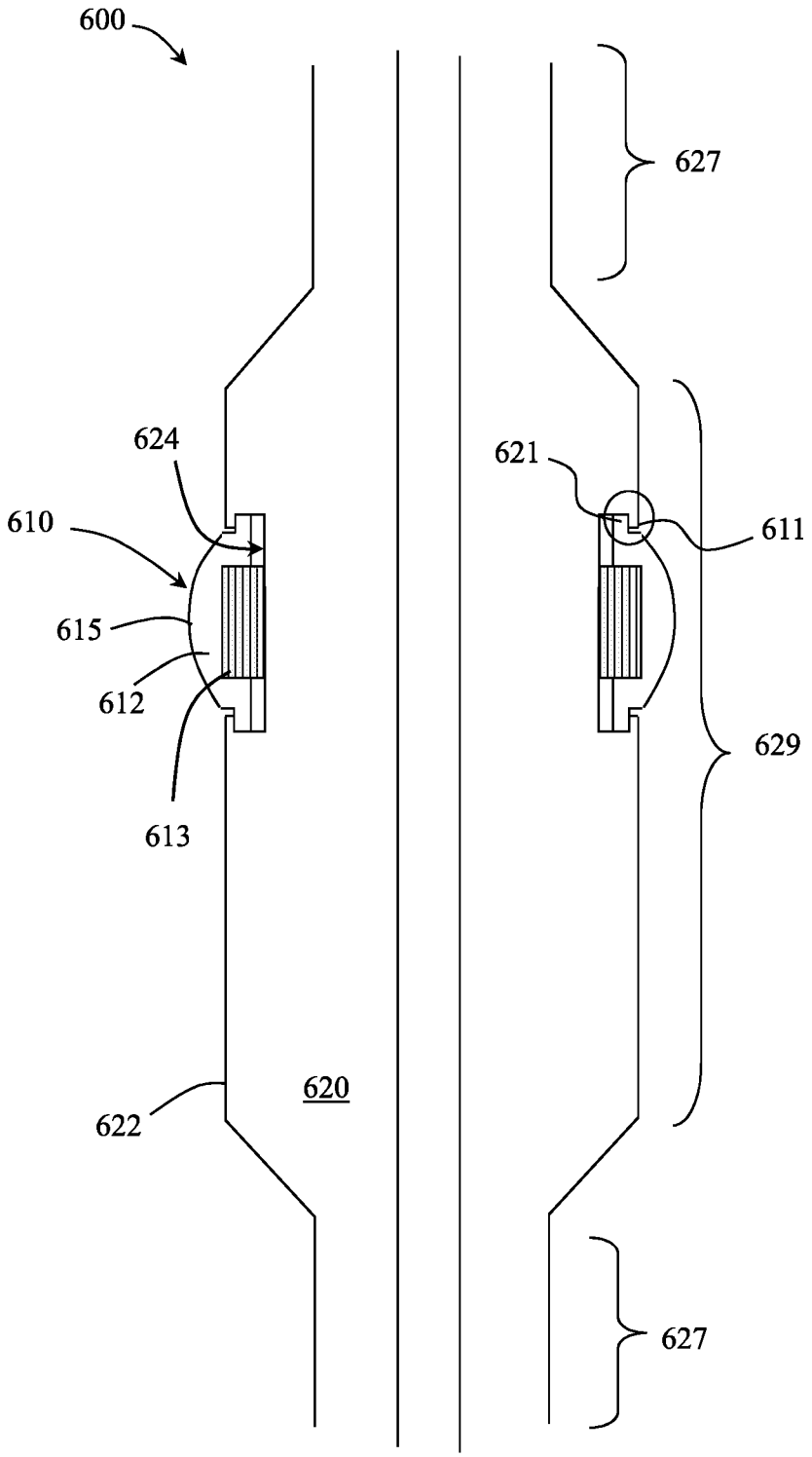
FIG. 6 shows a cross sectional view of a running tool according to embodiments of the present disclosure.

FIG. 6 shows another example of a running tool having a gripping element disposed around an elongate body, where the gripping element has a radially compressible gripping portion, and where the body has a corresponding shape to allow the gripping portion to radially compress. In the embodiment shown, the running tool 600 includes a gripping element 610 having multiple radially compressible gripping portions disposed around the circumference of an elongate body 620. The outer surface 622 of the body 620 defines a generally cylindrical profile having a wider portion 629 between two narrow portions 627, the wider portion 629 having a generally larger diameter than the narrow portions 627. The wider portion has a plurality of recesses 624 formed around the circumference of the body 620 at a first axial position.

The gripping elements 610 include a gripping portion 612 having a curved outer surface 615 and a spring 613. The spring 613 may have a spring constant that maintains the gripping portion 612 in a protruded or radially expanded position until a minimum shear force is applied to the gripping portion 612 outer surface 615. For example, the gripping portion 612 may move radially inward within the recesses 624 when the gripping portion 612 is inserted within a portion of a bearing assembly with a minimum axial force, such that the portion of the bearing assembly engages the gripping portion 612 and exerts at least the minimum shear force on the gripping portion 612 to overcome the spring constant of the spring 613 and move the gripping portion 612 radially inward.

The recesses 624 may have a generally rectangular shape and may have gripping elements 610 disposed therein. Further, gripping elements 610 and recesses 624 may have one or more radially overlapping protruding edges 611, 621. The recess protruding edge(s) 621 may be formed by a recess shape having a generally larger base than opening. The overlapping protruding edges 611, 621 may form an interlocking feature between the recess 624 and gripping element 610, such that the gripping element 610 is radially retained within the recess 624. In other words, a protruding portion 621 of recess 624 may overlap with a protruding portion 611 of gripping element 610, where the recess protruding portion 621 is radially outward from the gripping element protruding portion 611 to prevent the gripping element 610 from coming out of the recess 624. Various interlocking shapes may be used to retain a spring-loaded gripping element in a recess.

According to embodiments of the present disclosure, running tools may be used to install or retrieve a bearing assembly. A bearing assembly may include a housing having a central bore extending therethrough and a lip formed at a distal end of the bearing assembly, the lip extending a distance radially inward.

Figure 7:
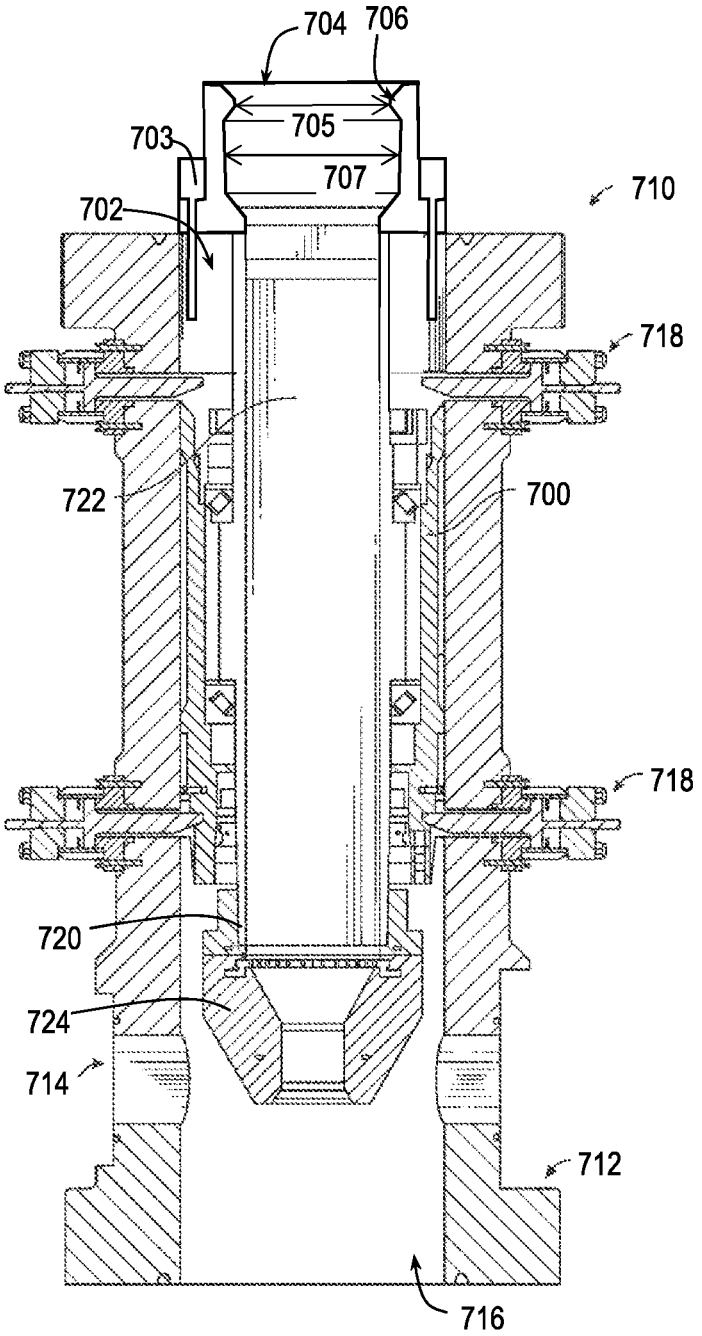
FIG. 7 shows a cross sectional view of a bearing assembly according to embodiments of the present disclosure.

For example, FIG. 7 shows an example of a bearing assembly configured for use with running tools of the present disclosure. The bearing assembly 700 is assembled within a housing 710 of a rotating control device. The housing 710 may include a connector 712 at a lower end to operatively connect the housing 710 to a marine riser (not shown). The housing 710 may be connected to the marine riser at a longitudinal position above or below the riser tensioning ring (not shown). The housing 710 may further include one or more side ports 714 for redirecting wellbore fluids entering the housing 710 from below into fluid return flow lines (not shown) hydraulically connected to a pressure recovery mud system (not shown).

The housing 710 may further include a bore 716 and fastening elements 718. The fastening elements 718 are provided to secure components of the rotating control device (e.g., bearing assembly 700) within the bore 716 of the housing 710. The fastening elements 718 may be features that extend into the bore 716 or retract therefrom to secure the components inside the bore 716. For example, the fastening elements 718 may be one or more pistons, bolts, screws or the like. The extension and retraction of the fastening elements 718 may be remotely controllable from a console located at the surface, for example. An array of fastening elements 718 may be provided at equal intervals along the perimeter of the housing 710. The array of fastening elements 718 may be provided at each longitudinal end of the housing 710. Specifically, an upper array of fastening elements 718 and a lower array of fastening elements 718 may be provided as shown in FIG. 7.

A removable, replaceable bearing assembly 700 may be mounted within the housing 710. A sealing assembly 720 for establishing a seal to a movable tubular (not shown) such as a tubing or drill pipe is rotatably and axially supported by the bearing assembly 700 including bearings and seal assemblies that isolate the bearing assembly from pressurized wellbore fluids. The sealing assembly 720 includes a bore 722 and a sealing element 724, both of which the tubing or drill pipe may extend through. The sealing element 724 may seal around and grip (for rotation with) the tubing or drill pipe.

The bearing assembly 700 may further include a connection element 704 mounted at an axial end of the housing 702 using fasteners 703. Fasteners 703 may include screws, bolts, latches or other fastener types. Further, the connection element 704 is shown as a separate element attached to the housing in FIG. 7; however, in some embodiments, a connection element may be formed integrally with the housing. The connection element 704 may have a lip 706 formed at a distal end of the bearing assembly. The lip 706 extends a distance radially inward to define a first inner diameter 705 (between the radially most inward portion) smaller than a second inner diameter 707 defined by the inner surface of the connection element 704 axially adjacent to the lip 706.

Running tools according to embodiments of the present disclosure may be inserted into and grip the connection portion of a bearing assembly using a radially compressible portion of the running tool. According to embodiments disclosed herein, running tools may include a gripping element disposed around an elongate body, where the gripping element has a radially compressible gripping portion adapted to grip the lip of a bearing assembly. The shape of the running tool body may be configured to allow the gripping portion to radially compress when the gripping portion is engaged with the lip and when the running tool is moved with a minimum axial force through the lip.

Running tools according to embodiments disclosed herein may be used to run in (i.e., send downward from a rig) a bearing assembly to a housing of the RCD, for example. Also, running tools may be used to retrieve a bearing assembly from the housing of the RCD back to the rig. Running tools according to embodiments of the present disclosure may be a single tool having these dual functions (i.e., both running in and retrieving the bearing assembly or other component).

During installation of a bearing assembly into a RCD, the gripping portion of a running tool may engage a first end surface of a lip on a connection portion of a bearing assembly to push the bearing assembly in an axially forward direction. Installation may further include inserting the bearing assembly into the RCD and latching at least one fastening element to secure the bearing assembly to the RCD. The gripping portion of the running tool may be pushed through the inner diameter defined by the lip by radially compressing. For example, a gripping portion may include a plurality of radially compressible collets at an end of a gripping element, where each of the collets has a raised portion adapted to grip the lip of the bearing assembly. The shape of the running tool body may be configured to allow the gripping portion to radially compress when the gripping portion is engaged with the lip and when the running tool is moved with a minimum axial force. During removal of a bearing assembly from a RCD, fastening elements retaining the bearing assembly to the RCD housing (e.g., latches) may be retracted to detach the bearing assembly from the RCD. The gripping portion engages a second end surface of the lip to pull the bearing assembly in an axially reverse direction with an axial force less than the minimum axial force (such that the gripping portion does not radially compress and remains engaged with the second end surface of the lip).

According to some embodiments, methods of manipulating a bearing assembly may include contacting a running tool to a distal end of a bearing assembly, where the running tool includes a gripping element having a radially compressible gripping portion disposed around an elongate body, and the distal end of the bearing assembly has a first inner diameter defined by a lip and a second inner diameter larger than the first inner diameter. The gripping portion may be engaged with a first end surface of the lip to radially compress the gripping portion, and then the radially compressed gripping portion may be pushed through the first inner diameter to the second inner diameter in an axially forward direction. When the gripping portion is pushed within the second inner diameter, the gripping portion may radially expand. The running tool may then be pulled in an axially reverse direction to engage the radially expanded gripping portion with a second end surface of the lip.

FIGS. 8-15 show an example of a method for manipulating a bearing assembly with a running tool according to embodiments of the present disclosure. The running tool 800 includes a gripping element 810 having a radially compressible gripping portion 812 disposed around an elongate body 820, where the radially compressible gripping portion 812 includes a plurality of collets 815. The gripping element 810 has a generally tubular shape disposed concentrically with the body 820, and a shear sleeve 840 having a generally tubular shape is disposed around at least a portion of the gripping portion 812 of the gripping element 810, also concentric around the body 820. The gripping element 810 may be slidably retained to the body 820 with at least one retention mechanism 830 inserted through slots formed in the retention end and attached to the body 820. The shear sleeve 840 may be retained to the body 820 with at least one breakable retention mechanism 850, and slidably retained to the gripping element 810 with at least one second retention mechanism 841. Methods for manipulating a bearing assembly may include using running tools having other configurations of radially compressible gripping portions, such as disclosed herein.

Figure 8:
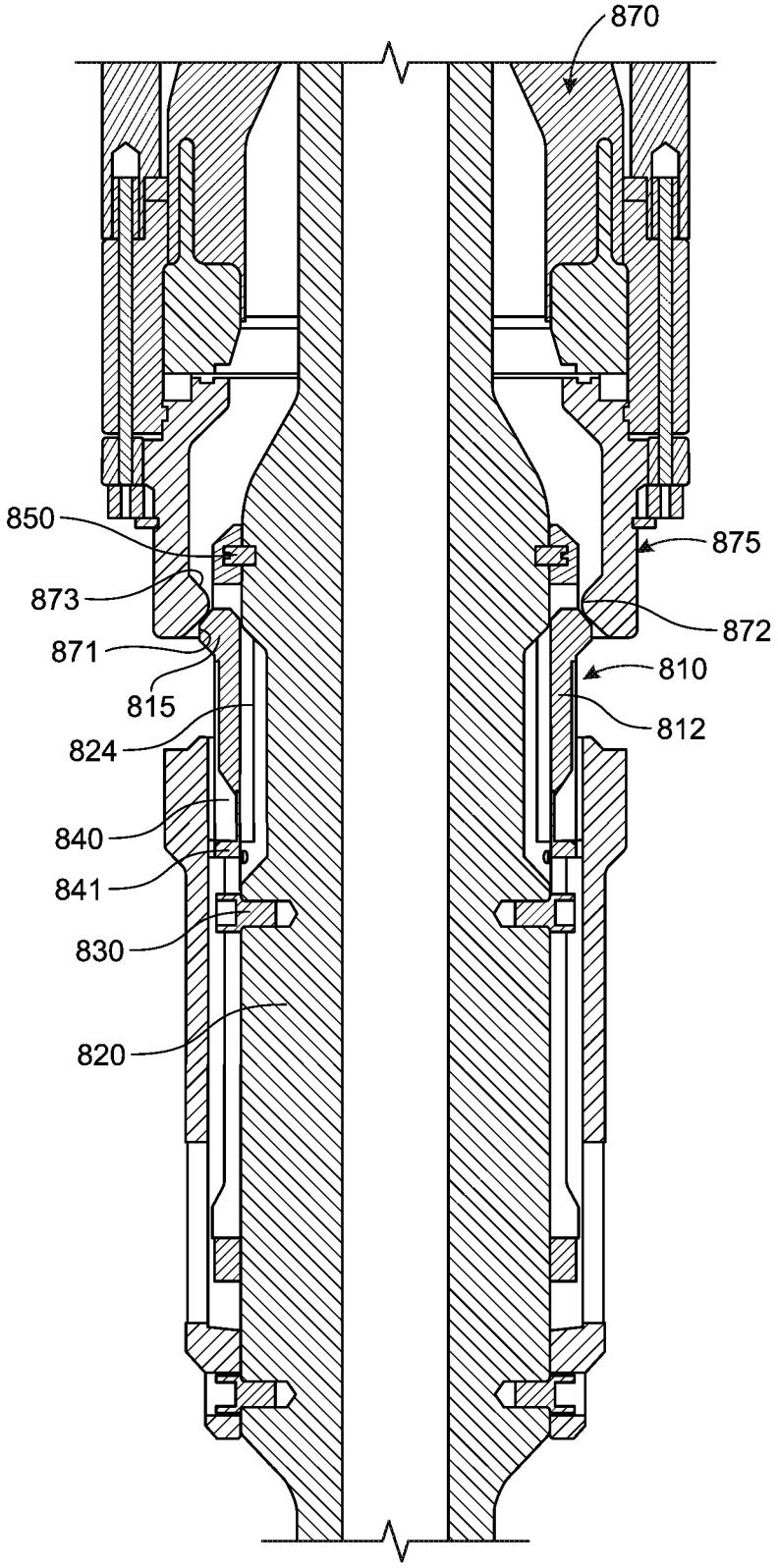
FIG. 8 shows a cross sectional view of a running tool according to embodiments of the present disclosure.

As shown in FIG. 8, the gripping portion 812 may contact a distal end 875 of a bearing assembly 870, the distal end 875 having a first inner diameter defined by a lip 872 and a second inner diameter larger than the first inner diameter. The distal end 875 may be formed by a connection element attached to an end of the bearing assembly 870.

Figure 9:
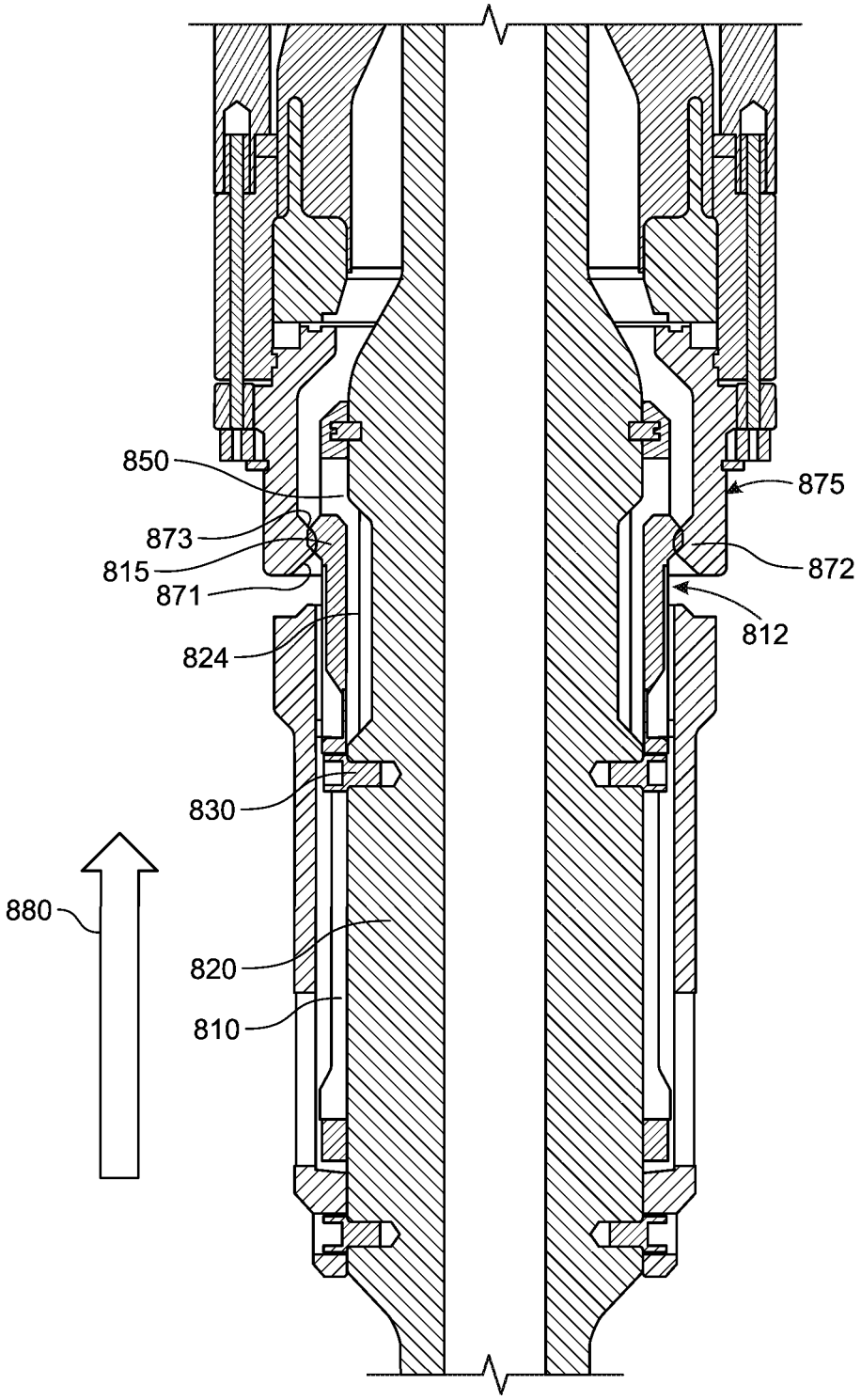
FIG. 9 shows a cross sectional view of a running tool according to embodiments of the present disclosure.

As shown in FIG. 9, the gripping element 810 is configured to move axially along the body 820 to a first axial position when engaging the gripping portion 812 with a first end surface 871 of the lip 872. The gripping element 810 may move axially along the body 820 via a retention mechanism 830 inserted through a slot formed in a retention end of the gripping element 810 and attached to the body 820, where the axial range of movement of the gripping element is limited by the length of the slot (which slides around the retention mechanism 830). Upon engaging the gripping portion 812 with the first end surface 871 of the lip 872, the gripping portion 812 may be pushed in an axially forward direction 880 to radially compress the gripping portion (e.g., the collet 815) into recess 824 formed in the body 820, such that the radially compressed gripping portion may slide through the first inner diameter to the second inner diameter of the bearing assembly 870.

Figure 10:
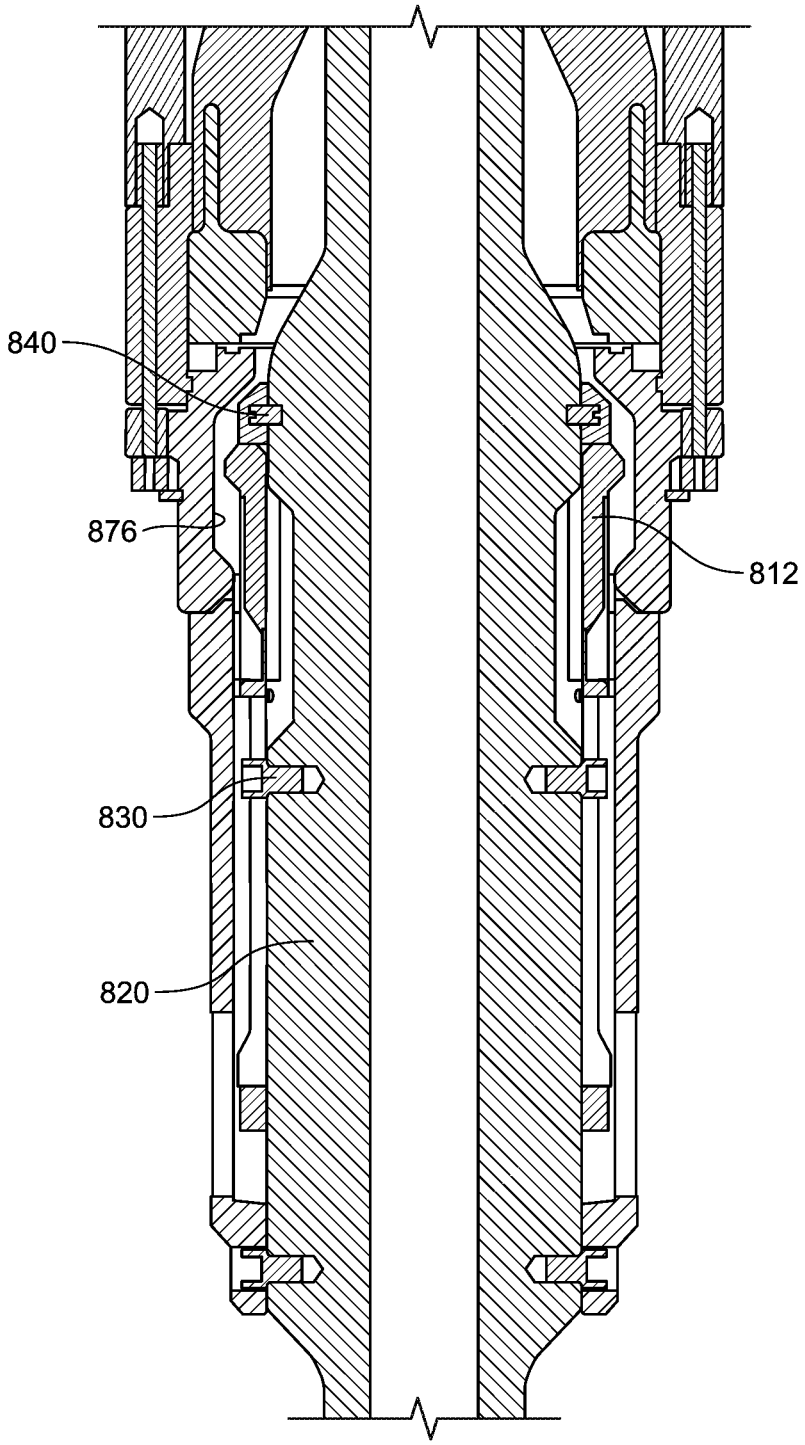
FIG. 10 shows a cross sectional view of a running tool according to embodiments of the present disclosure.

As shown in FIG. 10, when the gripping portion 812 is pushed within the second inner diameter of the bearing assembly 870, defined between inner surface 876, the gripping portion 812 may return to its initial position. In some embodiments, when the gripping portion 812 returns to its initial position, the gripping portion contacts the inner surface 876, and in some embodiments, when the gripping portion 812 returns to its initial position, the gripping portion does not contact the inner surface 876.

Figure 11:
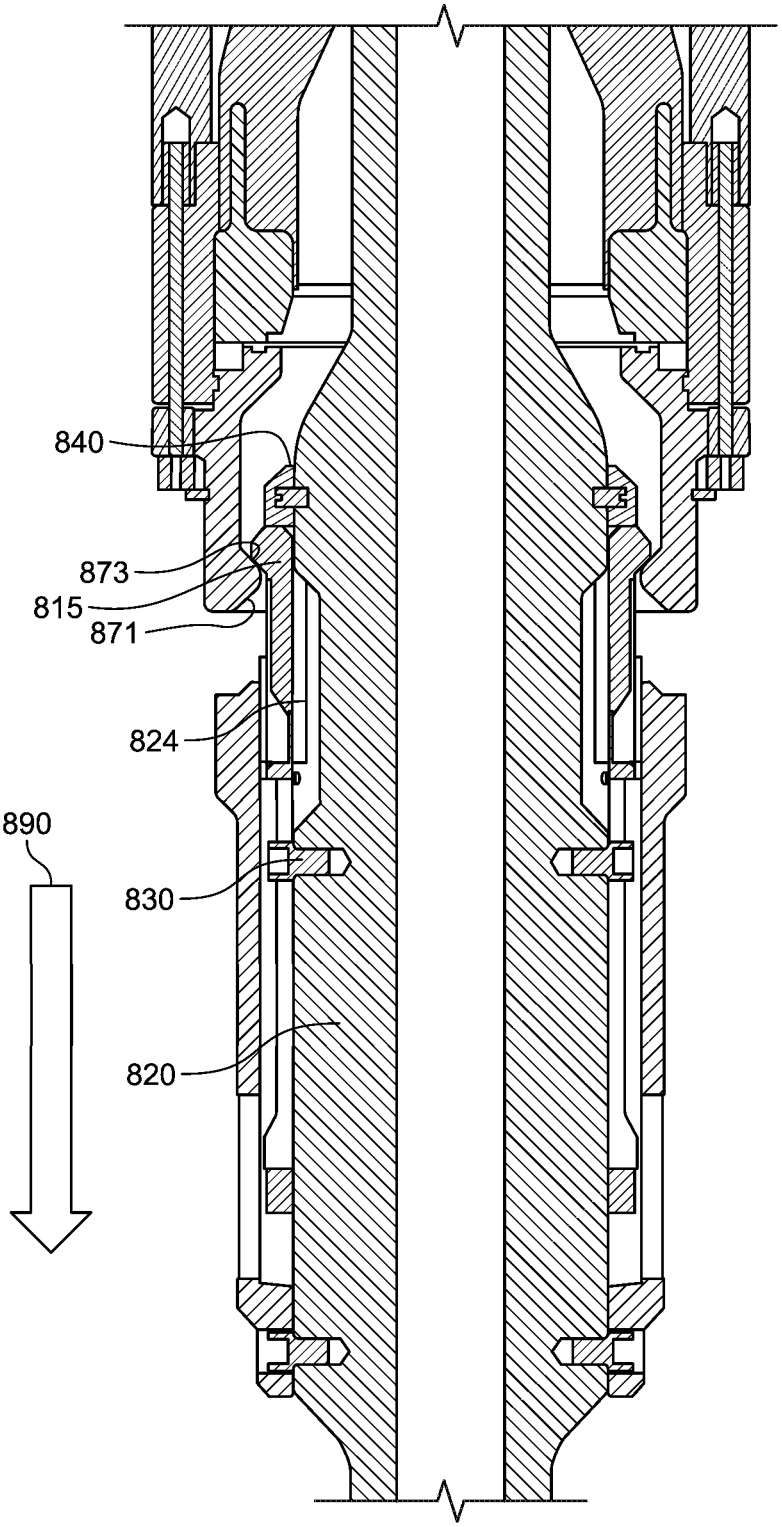
FIG. 11 shows a cross sectional view of a running tool according to embodiments of the present disclosure.

As shown in FIG. 11, the running tool may then be pulled in an axially reverse direction 890 to engage the radially expanded gripping portion 812 with a second end surface 873 of the lip 872.

Figure 12:
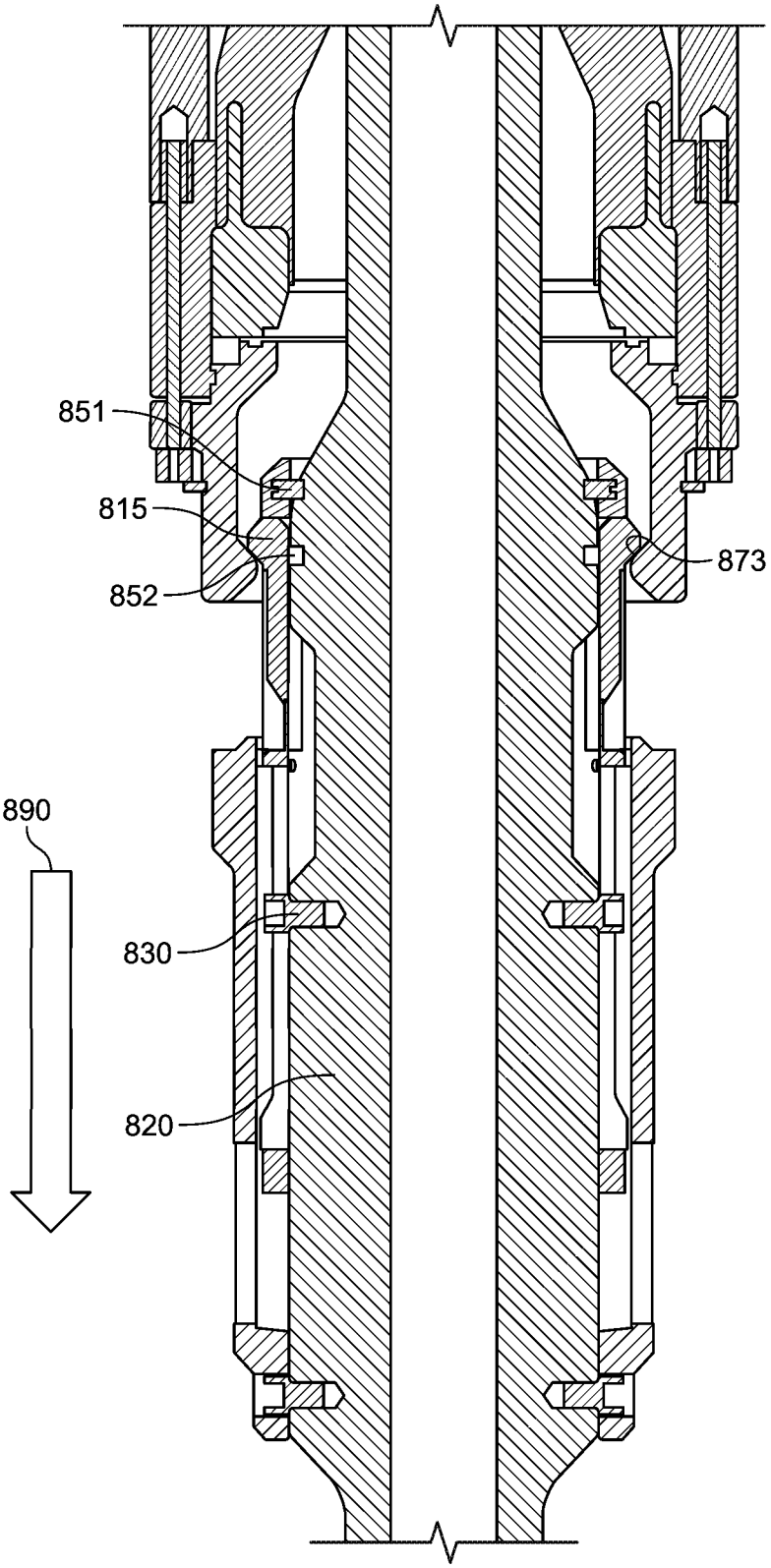
FIG. 12 shows a cross sectional view of a running tool according to embodiments of the present disclosure.

As shown in FIG. 12, the running tool may be pulled in the axially reverse direction 890, the contact between the gripping portion 812 and the second end surface 873 of the lip being maintained, with an axial force sufficient to break the breakable retention mechanisms. As shown, the breakable retention mechanisms may be shear screws, where upon being broken, top portions 851 of the shear screws may be sheared off bottom portions 852 of the shear screws 850, and the bottom portions 852 may be trapped in the body 820 by the collets 815. In some embodiments, other forms of breakable retention mechanisms (e.g., adhesives, latches, etc.) may be used to temporarily restrain a gripping portion within an axial range.

Axial force sufficient to break a breakable retention mechanism temporarily holding a gripping element in an axial range may be provided by fastening the bearing assembly to a rotating control device using at least one fastening element (e.g., latches or bolts) having a retention strength stronger than the shear strength of the breakable retention mechanism. In such embodiments, when the breakable retention mechanism is broken and the gripping element is capable of sliding into the second axial position, the gripping portion may be radially compressed through the bearing assembly distal end for retrieval of the running tool without retrieving the bearing assembly. However, as described more below, in embodiments where the running tool is being used to retrieve the bearing assembly, the bearing assembly may be detached from an RCD prior to pulling the running tool in an axially reverse direction, thereby providing the weight of the bearing assembly (rather than weight from bearing assembly and RCD installation) as an axial force on the breakable retention mechanism. In such embodiments, the weight of the detached bearing assembly may not provide sufficient force to break the breakable retention, thereby preventing the gripping portion from sliding into the second axial position and being radially compressed. When the gripping portion is not compressed, the gripping portion may engage with and pull the lip of the bearing assembly to retrieve the bearing assembly along with the running tool.

Figure 13:
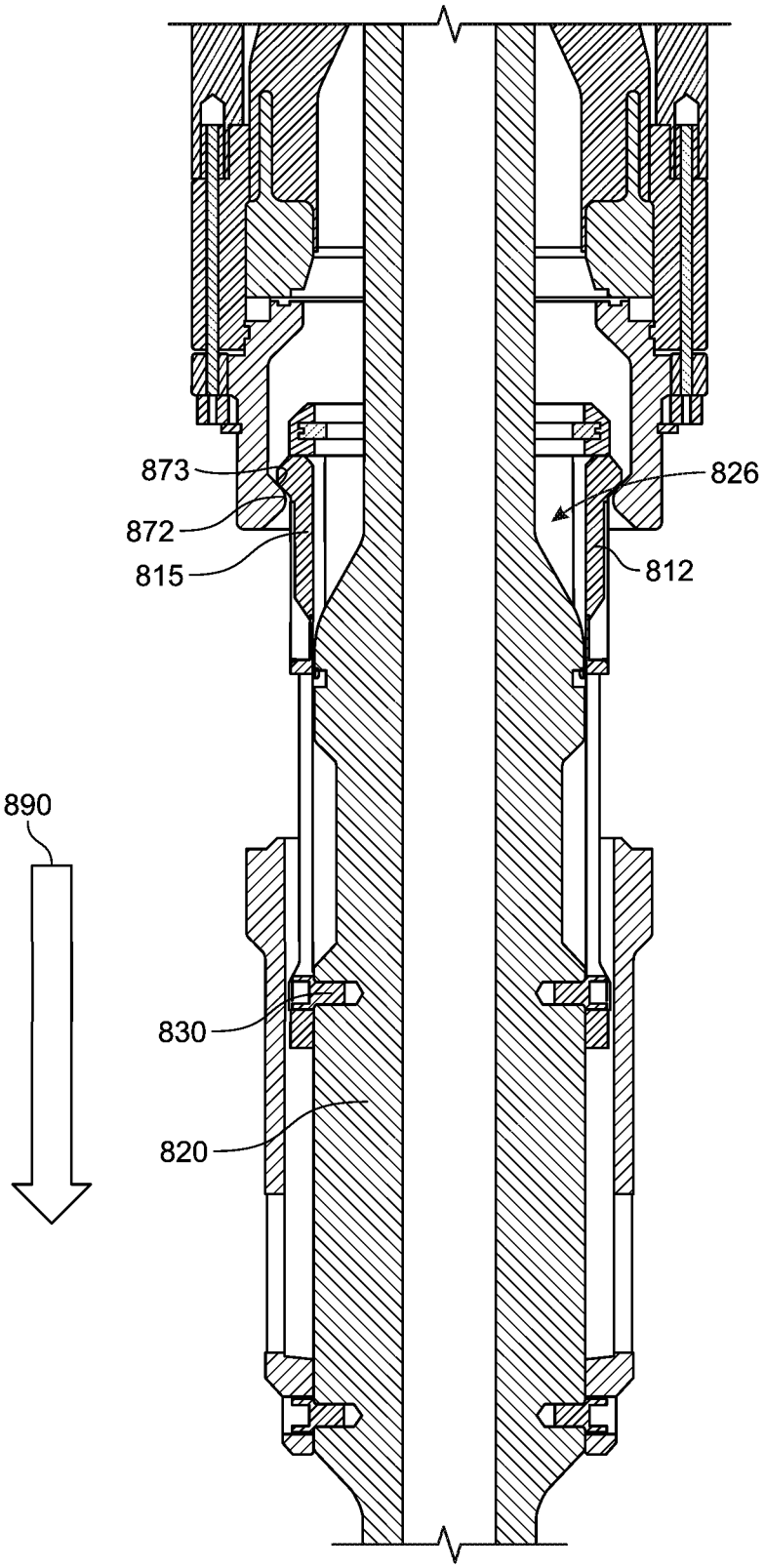
FIG. 13 shows a cross sectional view of a running tool according to embodiments of the present disclosure.
Figure 14:
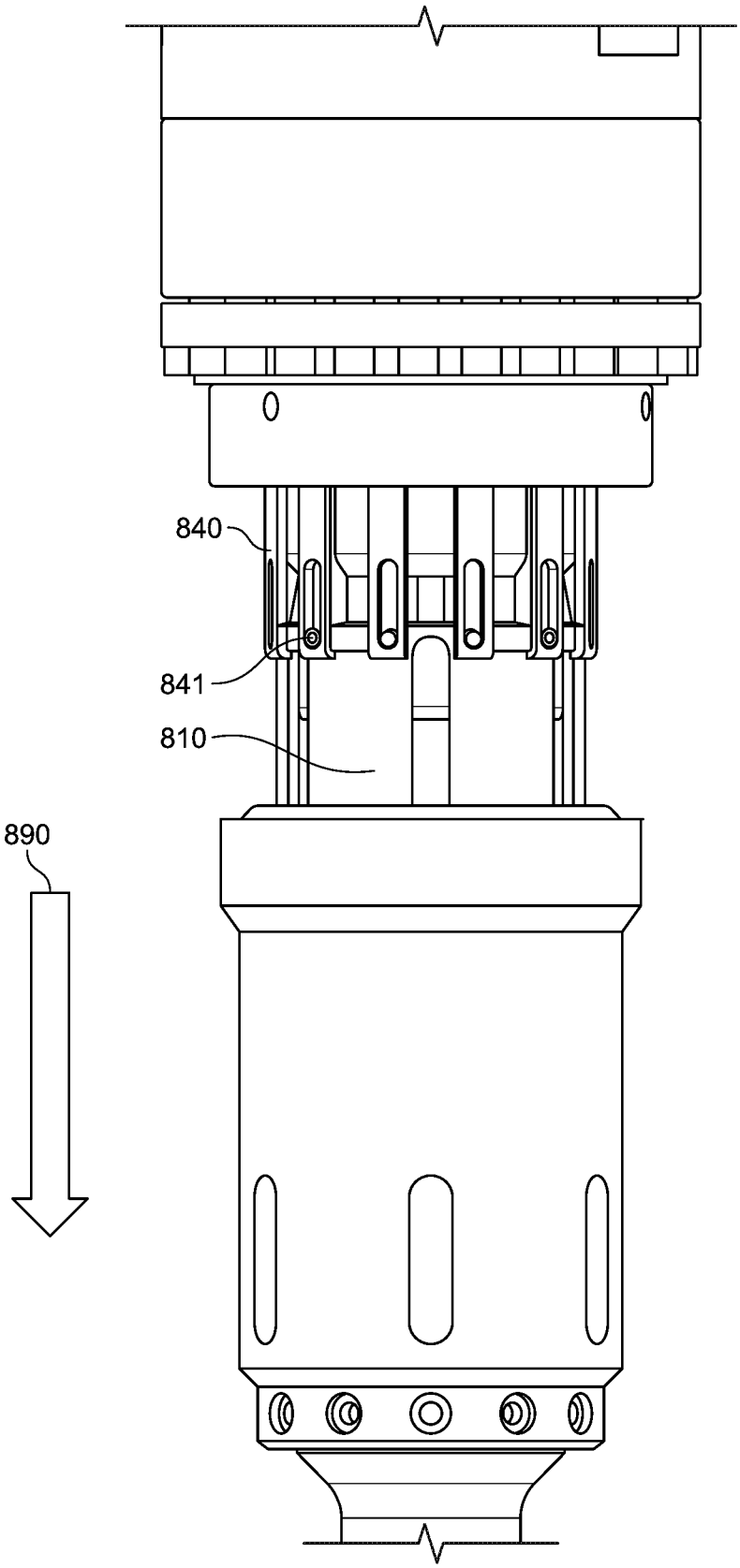
FIG. 14 shows a cross sectional view of a running tool according to embodiments of the present disclosure.

Referring now to FIG. 13, where the running tool is used to install a bearing assembly, the running tool may be continued to be pulled in the axially reverse direction 890 with the gripping portion 812 contacting the second end surface 873 of the lip 872 to move the gripping element 810 to a second axial position. In the second axial position, the collets 815 radially compress into recess 826 formed in the body 820 as the running tool is pulled in the axially reverse direction 890 moving the radially compressed collets 815 through the first inner diameter of the bearing assembly 870. FIG. 14 shows a perspective view of the running tool positioning in FIG. 13. As seen, the running tool may be pulled in the axially reverse direction 890 until the gripping element 810 and shear sleeve 840 are in fully extended position. In fully the extended position, the shear sleeve 840 may be extended to where the second retention mechanisms 841 are slid to an axial end of slots formed in the shear sleeve 840 in the axially reverse direction. The shear sleeve 840 thus moves axially with respect to the gripping element 810, while the gripping element 810 may move axially with respect to the body 820. The shear sleeve 840 may be used to temporarily retain the gripping element 810 within an axial range along the body 820, until the breakable retention mechanism 850 of the shear sleeve is broken, thereby allowing the gripping element 810 a larger axial range along the body 820.

Figure 15:
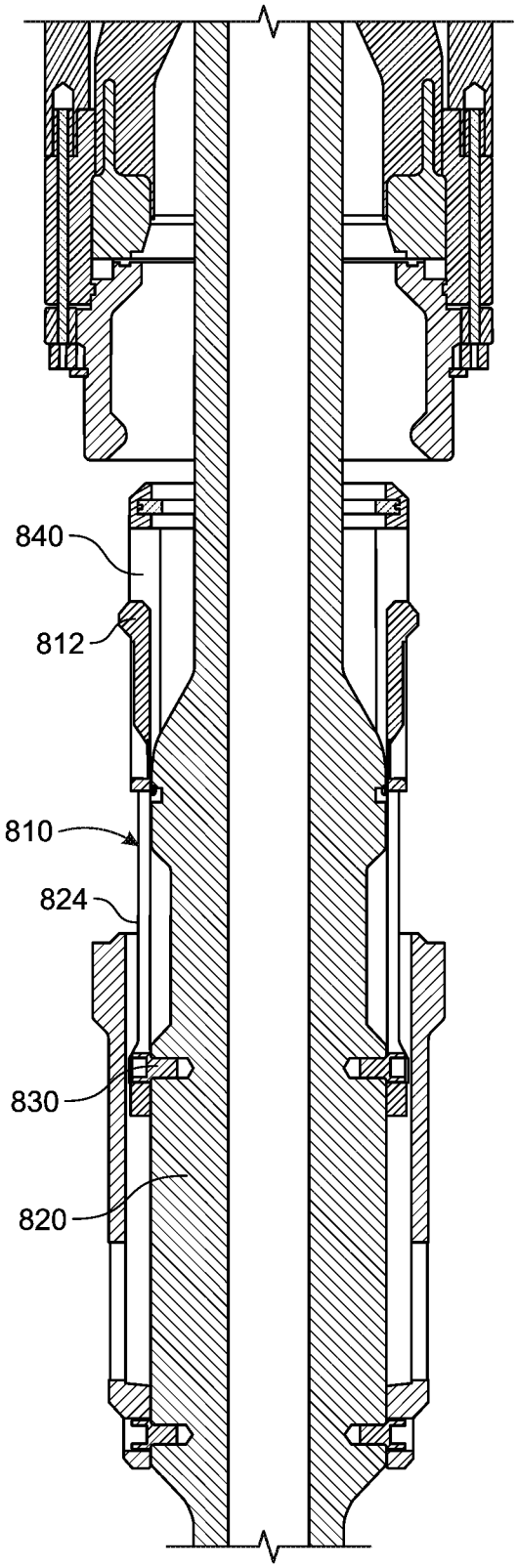
FIG. 15 shows a cross sectional view of a running tool according to embodiments of the present disclosure.

As shown in FIG. 15, after the gripping portion 812 of the gripping element is radially compressed through the first inner diameter of the bearing assembly 870, the running tool may then be pulled out of the bearing assembly distal end and retrieved without retrieving the bearing assembly. However, as described herein, in embodiments where the running tool is being used to retrieve the bearing assembly, the bearing assembly may be detached from an RCD prior to pulling the running tool in the axially reverse direction, such that the gripping portion of a gripping element does not radially compress, but instead remains radially outward to engage and pull on a lip of a bearing assembly.

In methods of installing a bearing assembly into a RCD, the bearing assembly may be inserted into the RCD using a running tool, such as described with respect to FIGS. 8-11, and fastened to the RCD (e.g., using one or more latching components, bolts, or interlocking features) to provide sufficient axial force to break the breakable retention mechanism and retrieve the running tool without retrieving the installed bearing assembly. In methods of retrieving a bearing assembly from a RCD, the bearing assembly may be unfastened or detached from the RCD such that insufficient force is provided to break the breakable retention mechanism, thereby allowing bearing assembly to be retrieved with the running tool.

For example, a running tool may be inserted into a distal end of a bearing assembly as shown in FIGS. 8-10, where the running tool has a gripping element 810 slidably coupled to and concentric around an elongate body, and where the gripping element has a plurality of collets 815 at a gripping portion 812 of the gripping element. As shown, the gripping element 810 may be configured to move axially along the body 820 to a first axial position. The distal end of the bearing assembly 870 may have a first inner diameter defined by lip 872 and a second inner diameter larger than the first inner diameter. The collets 815 may engage the first end surface 871 of the lip 872 to move the gripping element 810 to the first axial position thereby radially compressing the collets 815 when in the first position. The radially compressed collets 815 may then be pushed through the first inner diameter to the second inner diameter in an axially forward direction 880, where in the second inner diameter, the collets 815 return radially to their initial position. The running tool may then be pulled in an axially reverse direction 890 to engage the collets 815 with a second end surface 873 of the lip 872.

The bearing assembly may be detached from a RCD in which it is disposed, such that when the running tool is pulled in the axially reverse direction, the breakable retention mechanisms 850 do not shear. The breakable retention mechanism 850 may have a shear strength great enough to maintain its integrity from the axial force applied from the weight of the detached bearing assembly during pulling the gripping element 810 in the axially reverse direction. The shear sleeve 840 may thus axially retain the gripping element 810 as the running tool is pulled in the axially reverse direction 890, where the collets 815 remain engaged with the second end surface 873 of the lip 872 and move the bearing assembly in the axially reverse direction.

In embodiments where a running tool having a spring-loaded gripping portion, such as shown in FIG. 6, is used to install a bearing assembly into a RCD, the gripping portion may be radially compressed by pushing the gripping portion through a relatively smaller inner diameter of a bearing assembly distal end using a shear force sufficient to compress the springs of the spring-loaded gripping elements. Once the bearing assembly is inserted into the RCD, the bearing assembly may be secured to the RCD. When secured to the RCD (e.g., using one or more fastening elements), the load provided by the bearing assembly secured to the RCD may provide sufficient shear force to compress the springs of the spring-loaded gripping elements and allow the compressed gripping elements to move past the relatively smaller inner diameter of the bearing assembly distal end, thereby allowing the running tool to be retrieved without retrieval of the bearing assembly.

According to some embodiments of the present disclosure, a method for retrieving a bearing assembly from a RCD may include contacting a running tool (such as those described herein) to a distal end of a bearing assembly, where the running tool has a gripping element with a radially compressible gripping portion. The radially compressible gripping portion may be inserted in an axially forward direction into a distal end of the bearing assembly (e.g., between a lip formed at the distal end of the bearing assembly) using an axial force sufficient to radially compress the gripping portion. Once inserted through the lip of the bearing assembly distal end, the bearing assembly may be detached from the RCD in which it is disposed (e.g., by remotely detaching one or more fastening elements extending from the RCD housing to the bearing assembly), and the running tool may be pulled in an axially reverse direction. With the bearing assembly detached from the RCD housing (and the running tool pulling the weight of the detached bearing assembly in the axially reverse direction), the weight of the bearing assembly provides insufficient axial force to radially compress the gripping portion, thereby allowing the gripping portion to maintain the grip with the lip of the bearing assembly and retrieve the bearing assembly along with the running tool.

While a limited number of embodiments have been described herein, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A tool, comprising:

an elongated body comprising:

an outer surface;

a first recess formed at a first axial position along the outer surface; and a second recess formed at a second axial position along the outer surface;

a gripping element extending around the outer surface of the body, the gripping element comprising:

a plurality of collets at a gripping portion of the gripping element; and a retention end;

a retention mechanism axially retaining the retention end of the gripping element within an axial length along the body to allow the plurality of collets to overlap with the first axial position and the second axial position of the body; and a shear sleeve having a plurality of openings disposed around the plurality of collets, each collet exposed through each of the openings.

2. The tool of claim 1, further comprising an outer housing attached to the body and defining an annular space between the outer housing and the body, where the gripping element is partially disposed in the annular space.

3. The tool of claim 1, further comprising a breakable retention mechanism attaching the shear sleeve to the body.

4. The tool of claim 3, wherein:

the tool is configured to install a bearing assembly in a rotating control device, the bearing assembly secured in the rotating control device via at least one latch; and a force to break the breakable retention mechanism between the shear sleeve and the body is less than a latching force from the at least one latch securing the bearing assembly in the rotating control device.

5. The tool of claim 1, wherein the retention mechanism comprises at least one cap screw extending through a slot formed through the retention end of the gripping element and attached to the body.

6. The tool of claim 1, wherein the first recess comprises an annular recess formed around the circumference of the body.

7. The tool of claim 1, further comprising at least one additional first recess, each of the first recess and the at least one additional first recess comprising linear grooves corresponding in circumferential position around the outer surface of the body to the plurality of collets when the plurality of collets are in the first axial position.

8. The tool of claim 1, wherein the shear sleeve is slidably coupled to the gripping element.

* * * * *